United States Patent [19]

Schepers et al.

[11] Patent Number: 4,988,462

[45] Date of Patent: Jan. 29, 1991

[54] NON-AQUEOUS CLEANING COMPOSITIONS CONTAINING BLEACH AND CAPPED NONIONIC SURFACTANT

[75] Inventors: Frederik J. Schepers; Charles C. Verburg, both of Vlaardingen, all of Netherlands

[73] Assignee: Lever Brothers Company, Division of Conopco, Inc., New York, N.Y.

[21] Appl. No.: 337,582

[22] Filed: Apr. 13, 1989

[30] Foreign Application Priority Data

Apr. 29, 1988 [GB] United Kingdom ..... 8810196
Oct. 14, 1988 [GB] United Kingdom ..... 8824109

[51] Int. Cl.[5] ..... C11D 1/722; C11D 7/54; C11D 3/20

[52] U.S. Cl. ..... 252/174.22; 252/135; 252/174.21; 252/528

[58] Field of Search ..... 252/135, 174.21, 174.22, 252/528

[56] References Cited

U.S. PATENT DOCUMENTS 4,088,598 5/1978 Williams ..... 252/135
4,548,729 10/1985 Schmid et al. ..... 252/174.21
4,624,803 11/1986 Balzer et al. ..... 252/527
4,655,954 4/1987 Broze et al. ..... 252/135
4,780,237 10/1988 Schmid et al. ..... 252/174.22
4,786,431 11/1988 Broze et al. ..... 252/99

FOREIGN PATENT DOCUMENTS 266199 4/1988 European Pat. Off. .
2158454 11/1985 United Kingdom .
2178754 2/1987 United Kingdom .
2182051 5/1987 United Kingdom .

*Primary Examiner*—Paul Lieberman
*Assistant Examiner*—James M. Silbermann
*Attorney, Agent, or Firm*—Ronald A. Koatz

[57] ABSTRACT

A substantially non-aqueous liquid cleaning product composition comprising solid particles dispersed in a liquid solvent phase, said composition comprising a bleach system which comprises a persalt bleach and a precursor therefor, said liquid solvent phase comprising a capped alkoxylated nonionic surfactant. When the capped nonionic is ester-capped, the presence of a further precursor is not essential.

10 Claims, No Drawings

NON-AQUEOUS CLEANING COMPOSITIONS CONTAINING BLEACH AND CAPPED NONIONIC SURFACTANT

The present invention relates to substantially non-aqueous liquid cleaning products of the kind comprising solid particles dissolved in a liquid phase, which composition comprises a persalt bleach and an activator therefor.

Non-aqueous products are preferred over aqueous systems when it is desired to incorporate a bleach or bleach system since these are highly unstable in the presence of water. However, in those non-aqueous liquids which comprise a bleach system having a persalt bleach and a precursor (activator), the precursor can still be unstable.

The exact mode of action of such precursors is not known, but it is believed that peracids are formed by reaction of the precursors with the inorganic peroxy compound, which peracids then liberate active-oxygen by decomposition.

They are generally compounds which contain N-acyl or O-acyl residues in the molecule and which exert their activating action on the peroxy compounds on contact with these in the washing liquor.

The applicants have now found that the precursors can be rendered significantly more stable if the liquid phase comprises a specific nonionic surfactant.

Thus according to the invention there is provided a non-aqueous liquid cleaning composition containing a persalt bleach and a precursor therefor, the composition being in the form of a liquid phase comprising a surfactant and a particulate solid phase dispersed therein, at least a major portion of said surfactant being a capped alcoxylated nonionic surfactant.

The capped alkoxylated nonionic surfactants comprise a saturated or unsaturated linear or branched fatty chain linked via one or more independently selected alkyleneoxy, e.g. $C_{1-4}$ alkyleneoxy groups to a terminal group which is other than hydrogen. This terminal or 'capping' group may be aliphatic or aryl, for example a long-chain alkyl or alkenyl group having from 5 to 15 carbon atoms, an alkyl group of 1 to 4 carbon atoms or a benzyl group. The surfactants capped with the $C_{1-4}$ alkyl, especially methyl groups, are preferred. It is, of course, advisable that the capping group be free of primary —OH groups.

Most preferred are those capped surfactants in which the capping group is of formula—COR where R is aryl or aliphatic, most preferably alkyl, e.g. methyl. Thus, the alkoxylated portion of the molecule terminates in an ester (—O COR) group instead of a hydroxy group. These compounds not only give excellent precursor stability but also can react with water on contact with the wash liquor to yield uncapped derivatives of proven detergency.

By way of example, the capped alkoxylated nonionic surfactants may have any structure according to the following general formula:

$$RO(C_2H_4O)_p(C_3H_6O)_qR^1$$

wherein R represents a straight or branched primary or secondary aliphatic hydrocarbon group, for example alkenyl, or more preferably alkyl, of from 8 to 24, e.g. from 10 to 15 carbon atoms, p is from 2 to 14 preferably 3 to 11, q is from 0 to 8, and $R^1$ is a capping group other than hydrogen, for example as hereinbefore described.

Most preferred of these are the solely ethoxylated capped nonionics, for example those of the above general formula wherein q represents zero. Other materials of interest are corresponding compounds containing butoxy or other alkoxy groups.

Surprisingly, we found that if the capped nonionic surfactant comprises an ester formed from an organic acid and an alkoxylated alcohol nonionic detergent, the ester can act as a precursor for a persalt bleach included in the composition, thus obviating the need for any other conventional precursor. These esters can also lower the pour point of the composition.

Regarding the structure of the ester, t should be noted that British patent specification No. GB 2 158 454 A discloses use of nonionic surfactants, modified to have a terminal —COOH group, as agents for preventing gelling of non-aqueous liquid detergent products when they are dispensed into water. In contrast however, this embodiment of the present invention is concerned with organic acids, particularly carboxylic acids of formula RCOOH where R is an aliphatic or aromatic residue for example $C_{1-4}$ alkyl or benzyl, the acid being esterified with an alkoxylated alcohol nonionic surfactant of formula $R^1$—A—OH where $R^1$ is a hydrophobic moiety, optionally attached to A via an ether linkage and A is an alkoxylene or polyalkoxylene linkage, to form a corresponding ester of formula $R^1$—A—O—COR.

In the case of the inorganic persalt bleaches, essential to the present invention, the precursor makes the bleaching more effective at lower temperatures, i.e in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone. The ratio by weight of the peroxy bleach compound to the precursor is from about 15:1 to about 2:1, preferably from about 10:1 to about 3.5:1. Whilst the amount of the bleach system, i.e. peroxy bleach compound and precursor, may be varied between about 5% and about 35% by weight of the total liquid, it is preferred to use from about 6% to about 30% of the ingredients forming the bleach system. Thus, the preferred level of the peroxy bleach compound in the composition is between about 5.5% and about 27% by weight, while the preferred level of the precursor is between about 0.5% and about 40%, most preferably between about 1% and about 5% by weight.

Typical examples of the suitable peroxybleach compounds are alkalimetal peroborates, both tetrahydrates and monohydrates, alkali metal percarbonates, persilicates and perphosphates, of which sodium perborate is preferred.

Precursors for peroxybleach compounds have been amply described in the literature, including in British patent specifications Nos. 836,988, 855,735, 907,356, 907,358, 907,950, 1,003,310, and 1,246,339, U.S. patent specification Nos. 3,332,882, and 4,128,494, Canadian patent specification No. 844,481 and South African patent specification No. 68/6,344.

Typical examples of precursors within these groups are polyacylated alkylene diamines, such as N,N,N$^1$,N$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

A particularly preferred precursor is N,N,N$^1$,N$^1$-tetra- acetylethylene diamine (TAED)

Peroxybenzoic acid precursors are known in the art, e.g. from GB-A-836988. Examples thereof are phenylbenzoate; phenyl p-nitrobenzoate; o-nitrophenyl benzoate; o-carboxyphenyl benzoate; p-bromophenyl benzoate; sodium or potassium benzoyloxybenzenesulphonate; and benzoic anhydride.

A preferred peroxybenzoic acid bleach precursor is sodium p-benzoyloxybenzene sulphonate of the formula:

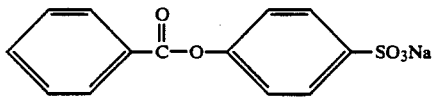

The organic peroxyacid compound bleaches which optionally may also be incorporated are preferably those which are solid at room temperature and most preferably should have a melting point of at least 50° C. Most commonly, they are the organic peroxyacids and water-soluble salts thereof having the general formula

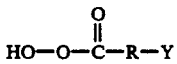

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution.

Another preferred class of peroxygen compounds which can be incorporated to enhance dispensing/dispersibility in water are the anhydrous perborates described for that purpose in the applicants' European patent specification No. EP-A-217,454.

Thus, cleaning products according to the invention are non-aqueous dispersions which comprise a non-aqueous liquid phase which can be a liquid surfactant, or a mixture thereof with other liquid ingredients such as an organic non-aqueous non-surfactant liquid. The compositions may contain a surfactant as a dispersed or dissolved solid, or more often, as all or part of said liquid phase. These surfactant compositions are liquid detergent products, e.g. for fabrics washing or hard surface cleaning However, the wider term 'liquid cleaning product' also includes low surfactant liquids which are still useful in cleaning, for example non-aqueous bleach products or those in which the liquid phase consists primarily of one or more light, non-surfactant solvents for greasy stain pre-treatment of fabrics prior to washing. Such pre-treatment products can contain solid bleaches, dispersed enzymes and the like.

As well as the liquid phase, such non-aqueous dispersions also contain dispersed particulate solids. These are small (e.g. 10 microns) particles of solid material which are useful in cleaning and as well as the bleach, could be solid surfactants, builders, enzymes or any other such solids known to those skilled in the art.

The particles can be maintained in dispersion (i.e. resist settling, even if not perfectly) by a number of means. For example, settling may be inhibited purely by virtue of the relative small size of the particles and the relatively high viscosity of the solvent phase. In other words, the particles settle very slowly at a rate predicted by Stokes' law or due to the formation of a loosely aggregated network of particle flocs. This effect is utilised in the compositions described in patent specifications No. EP-A-30 096 and GB 2 158 838A. However, there have been several proposals to utilise additional means to enhance solid-suspending properties in such non-aqueous liquids. These are somewhat analogous to so-called external structuring techniques used in aqueous systems; i.e., in addition to the particulate solids and the liquid solvent phase in which they are to be suspended, an additional dispersant is used which by one means or another, acts to aid stable dispersion or suspension of the solids for a finite period.

One known means for the stabilisation of a dispersion of solids in non-aqueous system, which may be utilised in the compositions of the present invention is to add an inorganic carrier material as the dispersant, in particular highly voluminous silica. This acts by forming a solid-suspending network. This silica is highly voluminous by virtue of having an extremely small particle size, hence high surface area. This is described in GB patent specifications Nos. 1,205,711 and 1,270,040. A problem with these compositions is setting upon prolonged storage. A similar appropriate structuring is use of fine particulate chain structure-type clay, as described in specification No. EP-A-34,387.

Another suitable substance which can be used as a dispersant for solid particles is a hydrolyzable copolymer of maleic anhydride with ethylene or vinylmethylether, which co-polymer is at least 30% hydrolyzed. This is described in specification No. EP-A-28,849 (Unilever). A problem with these compositions is the difficulty in controlling manufacture to obtain reproducible product stability.

A preferred means by which such dispersions may be stabilised in the compositions of the present invention is the use of a dispersant material which has been termed 'a ceflocculant', according to the disclosure of the applicants' EP-A-266199.

All composition according to the present invention are liquid cleaning products. They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialised cleaning products, such as for surgical apparatus or artificial dentures. They may also be formulated as agents for washing and/or conditioning of fabrics.

In the case of hard-surface cleaning, the compositions may be formulated as main cleaning agents, or pre-treatment products to be sprayed or wiped on prior to removal, e.g. by wiping off or as part of a main cleaning operation.

In the case of warewashing, the compositions may also be the main cleaning agent or a pre-treatment product, e.g. applied by spray or used for soaking utensils in an aqueous solution and/or suspension thereof.

Those products which are formulated for the cleaning and/or conditioning or fabrics constitute an especially preferred form of the present invention. These compositions may for example, be of the kind used for pre-treatment of fabrics (e.g. for spot stain removal) with the composition neat or diluted, before they are rinsed and/or subjected to a main wash. The compositions may also be formulated as main wash products, being dissolved and/or dispersed in the water with which the fabrics are contacted. In that case, the composition may be the sole cleaning agent or an adjunct to another wash product. Within the context of the present invention, the term 'cleaning product' also embraces compositions of the kind used as fabric conditioners (including fabric softeners) which are only added in the rinse water (sometimes referred to as 'rinse conditioners').

Thus, the compositions will contain at least one agent which promotes the cleaning and/or conditioning of the article(s) in question, selected according to the intended application. Usually, this agent will be selected from enzymes, microbiocides, (for fabrics) fabric softening agents and (in the case of hard surface cleaning) abrasives, in addition to the essential surfactant and bleach system. Of course in many cases, more than one of these agents will be present, as well as other ingredients commonly used in the relevant product form.

The compositions will be substantially free from agents which are detrimental to the article(s) to be treated. For example, they will be substantially free from pigments or dyes, although of course they may contain small amounts of those dyes (colourants) of the kind often used to impart a pleasing colour to liquid cleaning products, as well as fluorescers, bluing agents and the like.

All ingredients before incorporation will either be liquid, in which case, in the composition they will constitute all or part of the liquid phase, or they will be solids, in which case, in the composition they will either be dispersed as particles, preferably deflocculated, in the liquid phase or they will be dissolved therein. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

Thus, where any further surfactants which may be present are solids, they will usually be dissolved or dispersed in the liquid phase. Where they are liquids, they will usually constitute part of the liquid phase. Some surfactants are also eminently suitable as deflocculants.

In general however, any further surfactants may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981. However, the compositions of the present invention must contain at least one capped alkoxylated nonionic surfactant.

Liquid surfactants are an especially preferred class of material to use in the liquid phase, especially polyalkoxylated types and in particular polyalkoxylated nonionic surfactants.

When deflocculated systems are to be formulated, as a general rule, the applicants have found that the most suitable liquids to choose as the liquid phase are those organic materials having polar molecules. In particular, those materials comprising a relatively lipophilic part and a relatively hydrophilic part, especially a hydrophilic part rich in electron lone pairs, tend to be well suited. This is completely in accordance with the observation that liquid surfactants, especially polyalkoxylated nonionics, are preferred.

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols preferably having from 8 to 20 carbon atoms. The capped derivatives of these comprise an essential component of the present invention. Other known include monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di- alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification No. EP-A-225,654, especially for use as all or part of the solvent. Also preferred are those ethoxylated nonionics which are the condensation products of fatty alcohols with from 9 to 15 carbon atoms condensed with from 3 to 11 moles of ethylene oxide Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the solvent.

Another class of suitable nonionics which may be incorporated, preferably at most in minor quantities, comprise the alkyl polysaccharides (polyglycosides-/oligosaccharides) such as described in any of specifications U.S. No. 3,640,998; U.S. No. 3,346,558; U.S. No. 4,223,129; EP-A-92,355; EP-A-99,183; EP-A-70,074, '75, '76, '77; EP-A-75,994, '95, '96.

Nonionic detergent surfactants normally have molecular weights of from about 300 to about 11,000. Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used. If such mixtures are used, the mixture must be liquid at room temperature.

Examples of suitable anionic detergent surfactants, which may be used, preferably at most, in minor quantities, are alkali metal, ammonium or alkylolamaine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10}$–$C_{24}$ alpha-olefins and subsequent neutralization and hydrolysis of the sulphonation reaction product.

Other surfactants which may be used, preferably at most in minor quantities, include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute all or part of the solvent, whilst the corresponding low molecular weight fatty acids (triglycerides) can be dispersed as solids or function as structurants.

Yet again, it is also possible to utilise small amounts of cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12}$–$C_{24}$ fatty acids. Ampholytic detergent surfactants are e.g. the sulphobetaines. Combinations of surfactants from within the same, or from different classes may be employed to advantage for optimising structuring and/or cleaning performance.

Non-surfactant liquids which are suitable as solvents include those having the preferred molecular forms referred to above although other kinds may be used, especially if combined with those of the former, more preferred types. Non-surfactant solvents which have molecular structures which fall into the former, more preferred category include ethers, polyethers, alkylamines and fatty amines, (especially di- and tri-alkyl- and/or fatty-N-substituted amines), alkyl (or fatty) amides and mono- and di-N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Many light solvents with little or no hydrophilic character are in most systems, unsuitable on their own if a deflocculated system is sought. Examples of these are lower alcohols, such as ethanol, or higher alcohols, such as dodecanol, as well as alkanes and olefins. However, combination with the surfactant essential to the compositions of the present invention makes their use possible. Even though they appear not to play a role in any deflocculation process, it is often desirable to include them for lowering the viscosity of the product and/o assisting soil removal during cleaning.

The compositions of the invention may contain the liquid phase (whether or not comprising a liquid non-surfactant) in an amount of at least 10% by weight of the total composition. The amount of the liquid phase present in the composition may be as high as about 90%, but in most cases the practical amount will lie between 20 and 70% and preferably between 20 and 50% by weight of the composition.

Preferably also, the compositions of the present invention contain a deflocculant (as hereinbefore defined) which may be any of those referred to in the published prior art or any described in the applicants EP-A-266199.

The level of the deflocculant material in the composition can be optimised by the means in the art but in very many cases is at least 0.01%, usually 0.1% and preferably at least 1% by weight, and may be as high as 15% by weight. For most practical purposes, the amount ranges from 2–12%, preferably from 4–10% by weight, based on the final composition.

The compositions according to the present invention preferably also contain one or more other functional ingredients, for example selected from detergency builders, other bleaches, and (for hard surface cleaners) abrasives.

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aliminosilicate-type materials, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous alumino silicates. Specific examples include sodium carbonate (with or without calcite seeds), potassium carbonate, sodium and potassium bicarbonates, silicates and zeolites.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers and their salts, such as those sold by BASF under the Sokalan Trade Mark.

The aluminosilicates are an especially preferred class of non-phosphorus inorganic builders. They are especially detrimental to precursor stability and therefore systems which contain them are those where the use of the capped nonionic according to the present invention can most valuably exert its effect. The aluminosilicates are for example crystalline or amorphous materials having the general formula $$Na_Z(AlO_2)_Z(SiO_2)_YxH_2O$$

wherein Z and Y are integers of at least 6, the molar ratio of Z to Y is in the range from 1.0 to 0.5, and x is an integer from 6 to 189 such that the moisture content is from about 4% to about 20% by weight (termed herein, 'partially hydrated'). This water content provides the best rheological properties in the liquid. Above this level (e.g. from about 19% to about 28% by weight water content), the water level can lead to network formation. Below this level (e.g. from 0 to about 6% by weight water content), trapped gas in pores of the material can be displaced which causes gassing and tends to lead to a viscosity increase also. However, it will be recalled that anhydrous materials (i.e. with 0 to about 6% by weight of water) can be used as structurants. The preferred range of aluminosilicate is from about 12% to about 30% on an anhydrous basis. The aluminosilicate preferably has a particle size of from 0.1 to 100 microns, ideally betweeen 0.1 and 10 microns and a calcium ion exchange capacity of at least 200 mg calcium carbonate/g.

Suitable other bleaches include the halogen, particularly chlorine bleaches such as are provided in the form or alkalimetal hypohalites, e.g. hypochlorites.

When the composition contains abrasives for hard surface cleaning (i.e. is a liquid abrasive cleaner), these will inevitably be incorporated as particulate solids. They may be those of the kind which are water insoluble, for example calcite. Suitable materials of this kind are disclosed in the applicants' patent specification Nos. EP-A-50,887; EP-A-80,221; EP-A-140,452; EP-A-214,540 and EP 9,942, which relate to such abrasives when suspended in aqueous media. Water soluble abrasives may also be used.

The compositions of the invention optionally may also contain one or more minor ingredients such as fabric conditioning agents, enzymes, perfumes (including deoperfumes), micro-biocides, colouring agents, fluorescers, soil-suspending agents (anti-redeposition agents), corrosion inhibitors, enzyme stabilizing agents, and lather depressants.

In general, the solids content of the product may be within a very wide range, for example from 1–90%, usually from 10–80% and preferably from 15–70%, especially 15–50% by weight of the final composition. The persalt and any other solid phase material should preferably be in particulate form and have an average particle size of less than 300 microns, preferably less than 200 microns, more preferably less than 100 microns, especially less than 10 microns. The particle size may even be of sub-micron size. The proper particle size can be obtained by using materials of the appropriate size or by milling the total product in a suitable milling apparatus.

The compositions are substantially non-aqueous, i.e. they little or no free water, preferably no more than 5%, preferably less than 3%, especially less than 1% by weight of the total composition. It has been found by the applicants that the higher the water content, the more likely it is for the viscosity to be too high, or even for setting to occur. However, this may at least in part be overcome by use of higher amounts of, or more effective deflocculants or other dispersants.

Since the objective of a non-aqueous liquid will generally be to enable the formulator to avoid the negative influence of water on the components, e.g. causing incompatibility of functional ingredients, it is clearly necessary to avoid the accidental or deliberate addition of water to the product at any stage in its life. For this reason, special precautions are necessary in manufacturing procedures and pack designs for use by the consumer.

Thus during manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the liquid phase ingredients in a dry vessel. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of aeratron. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

The invention will now be illustrated by way of the following examples.

Three liquids were prepared with the compositions given below. After 4 weeks storage at 37° C. (to simulate prolonged storage) the amount of precursor (activator) remaining was measured as the result quoted.

The invention will now be illustrated by the following non-limiting examples.

EXAMPLES 1 to 3

All examples contained 24% partially hydrated zeolite, 15% sodium perborate monohydrate, 5% glyceryl tri-acetate and 4% TAED, all percentages being by weight The balance was the nonionic specified.

| Ex | Nonionic | % of original Activator (GTA/TAED) remaining after 4 weeks at 37° C. |
|---|---|---|
| 1 | Dobanol 91-5 (a) | 19 (after only 2 weeks) |
| 2 | Dobanol 91-6T (b) | 67.5 |
| 3 | Dobanol 25-9 (c) | 73.0 |

(a) A nonionic surfactant which is approximately a $C_9$ to $C_{11}$ alcohol, ethoxylated with an average of 5 ethylene oxide groups per molecule (b) A nonionic surfactant which is approximately a C to $C_{11}$ alcohol, ethoxylated with an average of 6 ethylene oxide groups and end-capped with a tertiary butyl group.

(c) A nonionic surfactant which is approximately a $C_{12}$–$C_{15}$ alcohol, ethoxylated with an average of 9 ethylene oxide groups and end capped with a $CH_3CO$— group.

N.B. The nonionic Dobanol 25-9 used in Example 3 is not liquid at room temperature but is at 37° C. It was chosen for expediency to demonstrate the effect of using an ester-terminated nonionic.

EXAMPLES 4 and 5

All examples contained 24% partially hydrated zeolite and 15% sodium perborate monohydrate, all percentages being by weight. The balance was the nonionic specified.

| Ex | Nonionic |
|---|---|
| 4 | Dobanol 91-5 (a) |
| 5 | Dobanol 25-9 (b) |

(a) uncapped (b) $CH_3CO$— capped

Example 4 is a reference whilst Example 5 is in accordance with the present invention.

At 0.5 g dosage into 100 ml of water, pH 11, ambient temperature, the composition of Example 4 gave no measurable peracid production. Under the same conditions, after 4 minutes for the composition of Example 5, 45%–50% by weight of the acetate capped nonionic was converted to the corresponding uncapped material and (by reaction with the perborate) peracid. After 10 minutes, the conversion was 75%.

We claim:

1. A non-aqueous liquid cleaning composition comprising from 10% to 90% by weight of a liquid phase comprising a surfactant, said surfactant consisting essentially of capped nonionic surfactant, from 10% to 90% of a particulate sold phase comprising a persalt bleach dispersed in said liquid phase and the composition containing a precursor for said persalt bleach, the weight ratio of said persalt bleach to said precursor being from 15:1 to 2:1 and the amount of both bleach plus bleach precursor being from 5 to 35% by weight of the composition.

2. A composition according to claim 1 wherein the capped nonionic surfactant is selected from compounds and mixtures of compounds of the formula $$RO(C_2H_4O)_p(C_3H_6O)_qR^1$$

wherein R represents a saturated or unsaturated, primary or secondary aliphatic hydrocarbon group, p is from 2 to 14, q is from 0 to 8 and $R^1$ is a capping group selected from aliphatic and aryl groups, said capping group being free of primary —OH groups.

3. A composition according to claim 2, wherein the capped nonionic surfactant is an ethoxylated fatty alcohol capped with a tertiary butyl group.

4. A composition according to claim 1, wherein said particulate solid phase additionally comprises an aluminosilicate builder.

5. A composition according to claim 1, further comprising a deflocculant for said particulate solid phase.

6. A cleaning product in the form of a non-aqueous liquid comprising from 10% to 90% by weight of a liquid phase comprising a surfactant, said surfactant consisting essentially of an ester-capped nonionic surfactant formed from an organic acid and an alkoxylated alcohol nonionic surfactant, from 10% to 90% of a particulate solid phase comprising a persalt bleach dispersed in said liquid phase, the weight ratio of said persalt to said precursor being from 15:1 to 2:1 and the amount of both bleach and bleach precursor being from 5 to 35% by weight of the composition.

7. A product according to claim 6, wherein the ester-capped nonionic surfactant is selected from compounds and mixtures of compounds of the formula $$RO(C_2H_4O)p(C_3H_6O)qCOR^1$$

wherein $R^1$ represents a saturated or unsaturated, primary or secondary aliphatic hydrocarbon group, p is from 2 to 14, q is from 0 to 8 and $COR^1$ is an aliphatic or aromatic acyl capping group free of primary —OH groups.

8. A product according to claim 7, wherein the —COR group is an acetyl group.

9. A product according to claim 6, wherein the ester-capped nonionic surfactant is an ethoxylated alcohol capped with an acetyl group.

10. A product according to claim 6, wherein said particulate phase additionally comprises an aluminosilicate builder.

* * * * *